United States Patent [19]

Widmayer

[11] 4,352,045

[45] Sep. 28, 1982

[54] ENERGY CONSERVATION SYSTEM USING CURRENT CONTROL

[75] Inventor: Don F. Widmayer, Bethesda, Md.

[73] Assignee: Flexiwatt Corporation, Rockville, Md.

[21] Appl. No.: 284,590

[22] Filed: Jul. 17, 1981

[51] Int. Cl.[3] ..... H05B 41/392; H05B 37/02

[52] U.S. Cl. ..... 315/291; 315/208; 315/240; 315/247; 315/287; 315/DIG. 4; 323/351

[58] Field of Search ..... 315/205, 208, 194, 199, 315/287, 291, 307, 311, DIG. 4, DIG. 7, 240, 247; 323/217, 320, 349, 324, 326, 351

[56] References Cited

U.S. PATENT DOCUMENTS 3,919,592 11/1975 Gray ..... 315/199

4,042,856 8/1977 Steigerwald ..... 315/205 X

*Primary Examiner*—Eugene R. La Roche

*Attorney, Agent, or Firm*—Larson and Taylor

[57] ABSTRACT

An electrical energy conservation control method and apparatus are provided which produce efficient control of the light output of either incandescent or fluorescent lamps or the outputs of other electrical load devices under circumstances where the rated output is not required. The control method and apparatus combines electronic (transistor) switching techniques with the use of reactive circuit components to provide control of the magnitude of current flowing through the load device during the AC input voltage sine wave and to permit some current flow at all times during each voltage half wave. The control technique is non-dissipative in the sense that losses are virtually limited to switching transitions and passive circuit element losses. The control is accomplished by controlling the time period that a transistor is saturated full-on. The transistor is saturated on at the beginning of each voltage half wave and continues to be saturated on until the point in time within each half wave when the transistor is turned off. At that point in time, a non-dissipative current-limiting capacitor provides an alternate current path for the load current. This operation combats the intrinsic non-linear characteristics of inductive loads and causes less power factor change.

20 Claims, 18 Drawing Figures

ENERGY CONSERVATION SYSTEM USING CURRENT CONTROL

FIELD OF THE INVENTION

The present invention relates to light control and regulating systems for fluorescent and incandescent lamps as well as to control systems for control of other electrical load devices.

BACKGROUND OF THE INVENTION

Among electrical load devices, a gas discharge lamp and its associated ballast form one of the most recalcitrant systems to control and the present invention provides specific advantages in this regard. Accordingly, the present invention will basically be described in connection with its use in such a system to illustrate the control capabilities of the invention. However, it will be understood that the invention is applicable to other lamp systems, e.g., incandescent, and to other electrical load devices.

A gas discharge lamp and the light output therefrom are difficult to control due to the phenomena associated with the conduction of electricity through gas. Fundamentally, such a lamp requires at least an electron emitter and an electron collector, i.e., a cathode and an anode (the lamp electrodes), and a suitable gas ion population contained within the lamp envelope. When a sufficiently high instantaneous voltage differential exists between the electrodes, electrons will flow from the cathode to the anode through the gas ion column. In so doing, the electrons collide with the gas ions, ultimately causing photons to be emitted. The wavelengths of these photons depend on the molecular structure of the gas. In some gas discharge lamps these arc generated photons are used directly for illumination. In the case of phosphor excited lamps, the arc generated photons are primarily used to excite the phosphor molecules coated on the inside of the glass envelope of the lamp. The excited phosphors in turn emit longer wavelength photons in the visual spectrum band. This process is sometimes called fluorescence.

There are at least three first order problems that contribute to making a gas discharge lamp difficult to control. First, when the gas is electrically conducting in the so-called arc discharge region (as opposed to other current magnitude-defined regions of conduction) the lamp exhibits a negative volt-ampere characteristic, meaning that the voltage drop across the lamp decreases as the arc current increases. This volt-ampere characteristic of the gas lamp is the opposite of that of an incandescent lamp or of other resistance types of electrical loads. For this reason, a gas discharge lamp must be driven from a current limited source in that, unless limited, the current will increase to a disastrous level. One way of limiting fluorescent lamp current is through the use of a current-limiting magnetic ballast.

The second major problem concerns the fact that the gas conducts only after arc ignition, and this only occurs during the higher amplitude portion of the voltage sine wave. This factor rules out voltage control except for a relatively narrow range because the arc drops out of conduction at around 75% of the rated line voltage.

The third major problem is that the lamp cathodes must be properly heated. In particular, the cathodes must be heated so that electrons are readily available as current carriers for the arc to conduct. Normally, this heating is accomplished by the arc itself and/or by the ballast transformer heater windings. It is important to note that if the cathodes are not kept at the required thermionic emission temperature, the useful lamp life can be substantially shortened. In the case of the widely used F-40 rapid start fluorescent lamp, the American National Standards Institute (ANSI) specifies that, after arc ignition, at least 2.5 volts is required at each cathode. This voltage, together with the arc heating, will maintain the cathode at suitable emitting temperature.

The cathode heating voltage of rapid start lamps is provided by voltage taps on the secondary winding of the rapid start ballast. The ballast also provides the voltage transformation and inductance necessary to strike and limit the arc current, respectively.

With the advent of the electronic switches such as thyristors, i.e., SCRs, and TRIACs, control techniques were developed that could limit the "one-time" of the arc current within each half wave of the power line AC voltage sine wave. This technique provides an apparent dimming effect. However, if the arc current "on-time" is limited while also employing a standard rapid start ballast, the cathode heating time is also limited and as a consequence the cathodes are not properly heated. For this reason, thyristor dimming ballasts were developed which include independent cathode heating windings. With a dimming ballast, the thyristor only controls the ballast winding associated with the lamp arc. This type of control can be characterized as being "off" at the beginning of each voltage half wave and being turned on at some point in time during the voltage half wave. The thyristor then remains on until near the end of the voltage half wave (zero crossover) when there is insufficient holding current to keep the thyristor turned on.

To overcome the need to use a relatively expensive dimming ballast, I have spent the past seventeen years developing fluorescent lamp control systems of different types. Some of the techniques I have developed are described in pending applications directed to the Energy Conserving Automatic Light Output (ECALO) system wherein the current flowing in the primary of the ballast is uniquely controlled within the time period of each half wave of the AC voltage sine wave. These pending applications include Ser. Nos. 945,842, of Sept. 26, 1978 and Ser. No. 51,136, filed on June 22, 1979. In the systems disclosed in these patents, a control transistor is saturated full-on and as the voltage rises, the transistor control circuit is designed to limit the transistor ballast current when a preset minimum level is reached. Therefore, when the current exceeds the preset value, the transistor is switched from the saturated full-on state to the active or limiting region of transistor operation for part of the remaining time period of the voltage half wave. If the minimum current is all that is required, then the transistor remains in the active region until the excess voltage declines to that required by the arc. At this time the transistor again is saturated full-on until the voltage declines to zero. The process is repeated in the next half cycle. If more average current is required, and this is preferably related to the level of light output, the transistor is then switched full-on before the end of the period of active current limiting transistor operation. Hence, the time of active transistor operation can be varied within each voltage half wave and thus the light output can be varied from a minimum to maximum level. However, during the period of time that the transistor is operating in the active region of each voltage half wave, the transistor must "absorb" some of A.C.

line voltage as seen at the ballast transformer winding voltage. Thus, the product of the voltage appearing across the collector and emitter of the transistor and the minimum or preset current flowing in the transistor emitter is power which must be dissipated by this transistor. The exact amount of dissipated energy will, of course, vary, depending on the time period within each half wave that the transistor is operating in the active region. The control provided by the ECALO system can therefore be described as a dissipative system which provides at least a minimum-on current in the earlier part of the time period of each voltage half wave which may be followed with a time controlled, full-on load compliance current during the latter portion of the voltage half wave.

SUMMARY OF THE INVENTION

In accordance with the present invention a novel control system is provided for a gas discharge lamp or other load devices which system eliminates the need for active region transistor operation and may improve the power factor of the electrical load device. The control provided by the invention differs from either the thyristor or ECALO-type control systems discussed above by producing a full-on load compliance current beginning in the early part of the time period of each voltage half wave. The system includes an electronic switch preferably comprising a control transistor which is saturated full-on during this initial period. The full-on current flowing through the control transistor can then be terminated at any point in time within the voltage half wave without interrupting the current flowing in the ballast primary, or other load device, because an alternate reactive current path is provided through a shunt connected capacitor. Therefore, the current continues flowing, through this alternative path, even though the transistor is turned off. Thus, the load current continues to flow but begins to limit as the capacitor charges during the latter portions of the time period of each AC half wave, and the current level during each half wave is controlled by the time period of the full-on transistor during the leading portion of the voltage half wave.

In a preferred embodiment, the control circuitry for the transistor includes an operational amplifier which produces a full-on control pulse at the beginning of each A.C. half wave, the duration of the pulse determining the time during which the transistor is saturated full-on. Advantageously, production of this pulse is controlled by a ramp voltage applied to the operational amplifier. More specifically, a fixed input voltage is supplied to the positive base of the operational amplifier which ensures that the output of the operational amplifier is at a first, high level so long as that input voltage exceeds the input voltage at the negative base. The ramp voltage is applied to the negative base and thus when the increasing ramp voltage exceeds the threshold set by the voltage at the positive base, the output of the operational amplifier drops to a second, lower level. In embodiments wherein the control system is employed in combination with fluorescent lamps, a capacitor charging circuit is preferably connected to a D.C. supply bus to provide that the positive output of the operational amplifier begins initially at maximum output and thereafter drops back to a predetermined reference level. In one embodiment, the reference level is advantageously set using a pair of potentiometers.

Other features and advantages of the invention will be set forth in, or apparent from, the description of the preferred embodiments found below.

DESCRIPTION OF THE PREFERRED EMBODIMENTS

Figure 1A:
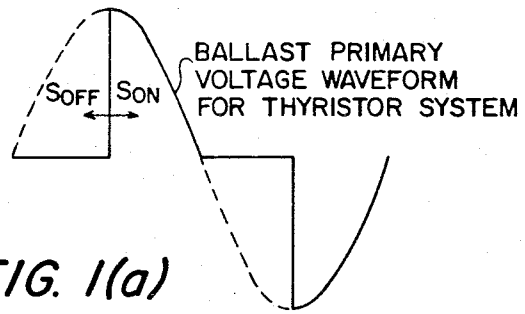
FIGS. 1(*a*) to 1(*c*) are voltage and current waveforms associated with prior art thyristor control systems.
Figure 1B:
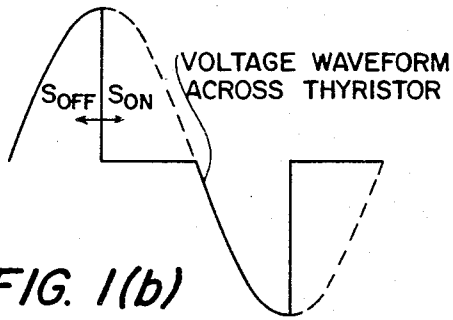
Figure 1C:
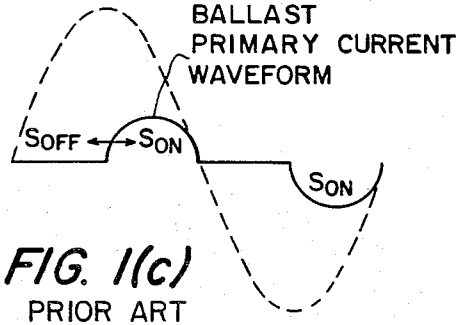
FIG. 1(c) PRIOR ART

Referring to FIGS. 1(*a*) to (*c*), 2(*a*) to (*c*) and 3(*a*) to (*c*), current and voltage waveforms are illustrated in order to demonstrate the basic differences between thyristor control, ECALO control and the control provided by the present invention, for a fluorescent lamp and conventional transformer ballast in controlling the light output of the lamp. The thyristor control illustrated in FIGS. 1(*a*) to 1(*c*) is non-dissipative except for the switching transition time and passive element losses. Since voltage turn-on occurs sometime after zero crossover, the current tends to flow towards the latter portion of the AC voltage sine wave and power factor correction may be required. It is noteworthy that, as illustrated in FIG. 1(*a*), the R.M.S. voltage across the ballast corresponds to only that portion of the source voltage present after the switch is turned on ($S_{on}$). Because the ballast voltage of a thyristor controlled system may be substantially reduced, and hence the cathode temperature reduced, a special dimming ballast is required to insure that there is sufficient heater winding voltage during the full range of control.

Figure 2A:
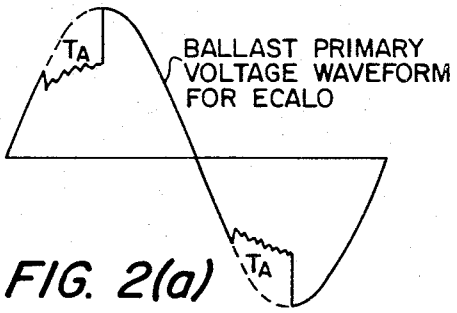
FIGS. 2(*a*) to 2(*c*) are corresponding voltage and current waveforms associated with my earlier developed ECALO system discussed above.
Figure 2B:
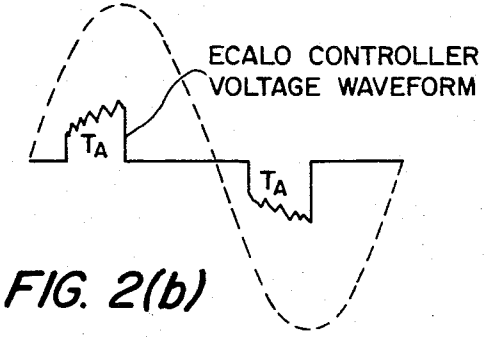
Figure 2C:
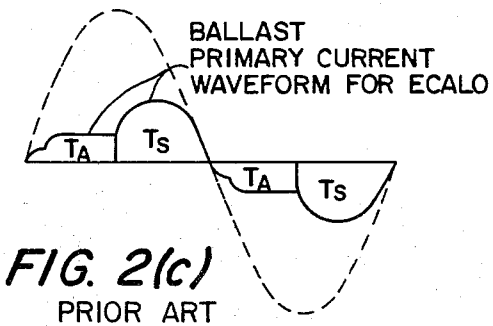
FIG. 2(c) PRIOR ART

The ECALO control system provides for a minimum-on current followed by a time varying full-on load compliance current and the full-on portion of the ECALO current flows towards the end of each voltage half wave. During the portion of time that the control transistor of the ECALO system is operating in the active region (marked $T_A$ in FIGS. 1(*a*) to 1(*c*)) the system is dissipating a relatively substantial amount of power (the product of the $T_A$ voltage and the $T_A$ current over the time period during which the two contemporaneously exist). It is also noted that the R.M.S. voltage reaching the ballast is much greater than that of a thyristor control system, as can be seen by comparing FIG. 2(*a*) and FIG. 1(*a*). In this regard, the ballast primary voltage of an ECALO equipped system is always of sufficient value to provide the heater windings of a standard ballast with sufficient drive voltage to provide the lamp cathodes with the necessary lamp firing voltage followed by the relatively small (2.5 V) sustaining voltage required to keep the cathodes at a minimum thermionic emission temperature. Thus, the cathode temperatures are sufficient to emit electrons without shortening lamp life. Also, because the arc current flows over the entire time frame that current can be conducted within the AC half wave, the current is less lagging than in a thyristor control system and, therefore, an ECALO system will cause less power factor change than a thyristor control system.

Figure 3A:
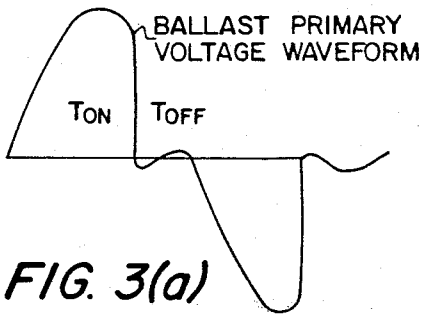
FIGS. 3(*a*) to 3(*c*) are corresponding voltage and current waveforms associated with the present invention.
Figure 3B:
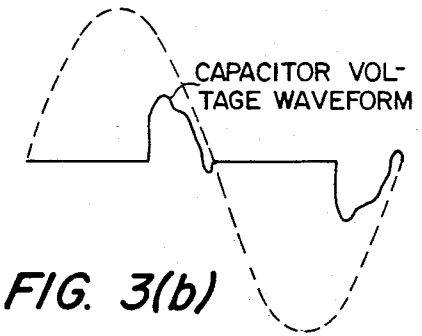
Figure 3C:
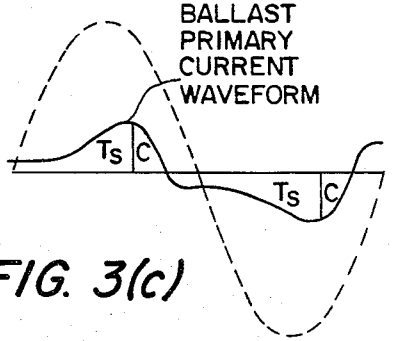

Referring to FIGS. 3(*a*) to (*c*), the present system is essentially non-dissipative, except for the switching transition time and passive circuit element losses but unlike a thyristor control system, the full-on load compliance current tends to flow more toward the beginning of the AC voltage sine wave (see FIG. 3(*c*)). Further, and in contrast to the ECALO system, the control transistor employed in the system of the invention, when used to conduct current, is always saturated full-on starting at the beginning of the AC voltage sine wave. Therefore, a full-on load compliance current is provided earlier in the half wave time frame than in either the ECALO or thyristor control systems. For this reason, and the operation of the alternate reactive current path described below, the system of the invention will cause less power factor change than the other two systems described above. As shown in FIG. 3(*a*), the R.M.S. voltage reaching the ballast primary is of sufficient value to provide the necessary energy to maintain the cathodes at the minimum thermionic emitting temperature. Therefore, the system of the invention can employ standard fluorescent lamp ballasts.

Figure 4:
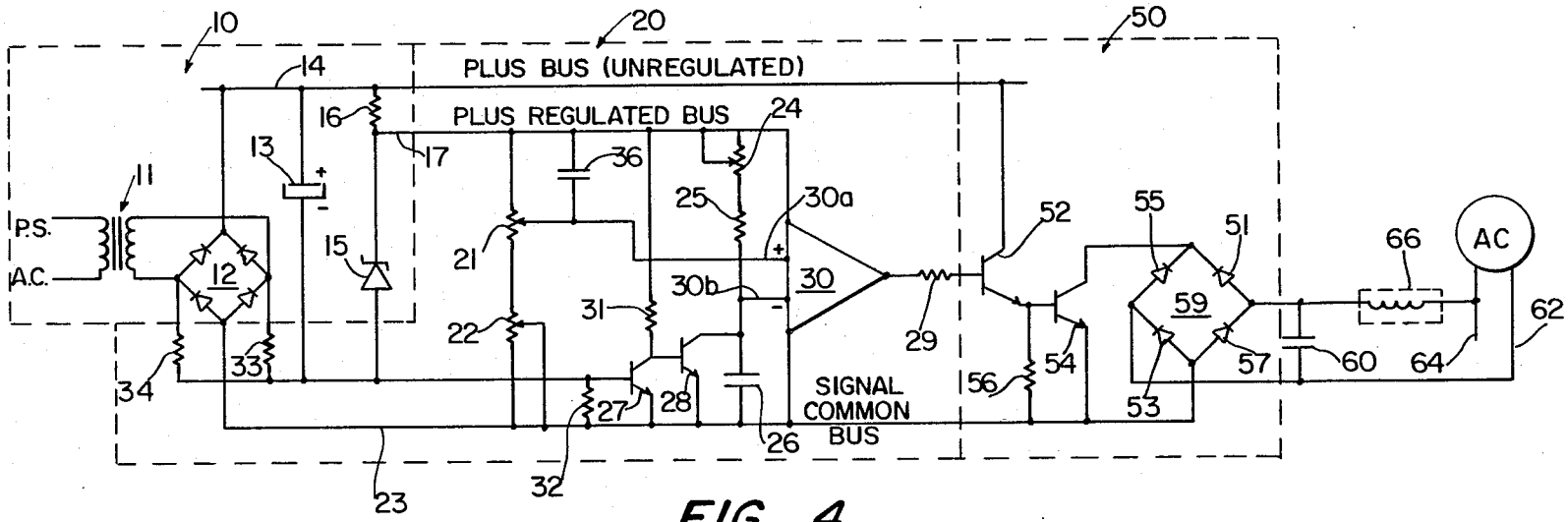
FIG. 4 is a schematic circuit diagram of a preferred embodiment of the control system of the invention.

Referring to FIG. 4, a schematic circuit diagram of a current control system in accordance with the invention is shown. The system can be viewed as having four functional sections. The first functional section is an AC to DC power supply 10, the second functional section is the control signal generation circuitry 20, the third functional section is a full-on current time controlled transistor circuit 50 and the fourth functional section constituted by a capacitor 60 which, as explained below, provides a current limiting non-dissipative reactive path for the load current to flow into when the full-on current, time controlled transistor circuit 50 is turned off within any given half wave.

The power supply 10 embodies standard circuitry and includes a transformer 11, which steps down the line voltage and provides power supply isolation. A full wave rectifying bridge 12 rectifies the AC secondary voltage and a capacitor 13 filters the rectified AC to provide an unregulated plus DC line or bus 14. A zener diode 15, connected in series with a resistor 16, provides a regulated DC positive or plus bus 17.

Turning now to the second section and considering the general operation thereof, the control signal generation circuitry 20 serves to generate a time controlled signal for the base of a control transistor 52 of control circuit 50 which transistor is turned full-on at the beginning of each AC voltage half wave. Transistor 52 then stays turned full-on until some point within the time period of the AC voltage half wave when the on-signal is turned off. This transistor turn-on, turn-off signal is generated responsive to the voltages applied to the plus and minus input bases of operational amplifier (op-amp) 30. When the plus input base 30*a* is positive with respect to the minus input base 30*b*, the output of op-amp 30 goes positive. Conversely, when the positive input base is negative with respect to the minus base the output goes negative. The output of op-amp 30 is connected to the base of transistor 52 through a resistor 29.

The plus base input signal for op-amp 30 is generated by a voltage divider consisting of potentiometers 21 and 22 connected in series between a "signal common" bus 23 and the plus DC regulated bus 17. For explanation purposes, assume potentiometers 21 and 22 are of equal value so that potentiometer 22 can then be used as a convenient minimum-level setting for potentiometer 21. For example, if the voltage on plus bus 14 is 8 volts, the voltage at the junction point between potentiometers 22 and 21 could then be set at from nominally zero to plus 4 volts by adjusting the position of the wiper arm of potentiometer 22. Therefore, the output voltage of potentiometer 21 would then only be variable from the minimum setting to that of the plus regulated bus. By adjustment of the potentiometers 21 and 22 the plus base input could, under these circumstances, be varied from zero (the voltage at signal common bus 23) to the level of the plus regulated D.C. bus 17.

The minus base input signal is generated by the current flowing from a potentiometer 24 and a resistor 25 to a charging capacitor 26 which generates a voltage ramp over time. Transistors 27, 28 and resistors 31, 32, 33 and 34 are configured as a reset circuit which momentarily turns on transistor 28 when the full wave diode bridge 12 is commutated by the secondary voltage of transformer 11. When transistor 28 is turned on, more or less at the AC zero crossover point in time, the stored energy of capacitor 26 is discharged through transistor 28. Capacitor 26, having been reset to zero volts (the voltage at signal common bus 23), again charges during the next half cycle and the charging-reset process repeats itself again during each half cycle.

Figure 5A:
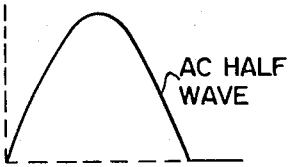
FIGS. 5(*a*) to 5(*c*) is a diagram of waveforms associated with the operation of the circuit of FIG. 4.
Figure 5B:
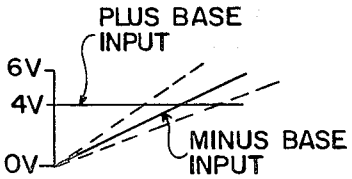
Figure 5C:
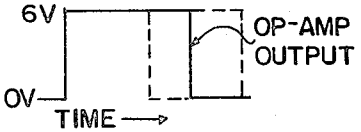

Referring to FIGS. 5(*a*) to (*c*), waveforms are shown which illustrate the circuit action of the plus and minus base input signals and the output action of op-amp 30 relative to the time period of each half wave of an AC voltage cycle. At the AC zero crossover (see FIG. 5(*a*)) the plus input base is shown as having been set at 4 volts and the minus base at zero volts, followed by a rising voltage ramp corresponding to the input at the minus base 30*b* (see FIG. 5(*b*)). The output of op-amp 30, starting at the AC zero crossover point, goes positive and continues positive until the point in time where the minus base input intersects and becomes more positive than the plus 4 volt plus input signal (see FIG. 5(*c*)). At that point or crossover, the output of op-amp 30 switches from positive to its most negative value. The time period of the positive output signal of op-amp 30 can be time controlled by variation of the resistance of potentiometer 24. A change in this resistance will increase or decrease the charging current flowing into capacitor 26, thereby varying the slope over time of the voltage ramp developed by capacitor 26. As illustrated in dashed lines in FIGS. 5(*b*) and 5(*c*), variation of the slope of the voltage ramp, in turn, changes the point where the ramp voltage, i.e., the minus base signal, exceeds the previously fixed plus base input signal. In other words, changing the crossover point where the minus base voltage exceeds the plus base voltage results in changing the time that the output signal of op-amp 30 remains positive within each AC half wave time period. Similarly, the same time variation control of the output of op-amp 30 can be achieved by fixing the resistance of potentiometer 24, and varying the voltage amplitude of the positive base input signal by, e.g., adjustment of the potentiometer 21.

As illustrated in FIG. 4, a capacitor 36 is connected in the plus base circuitry, between the plus regulated bus 17 and the wiper arm of potentiometer 21. Capacitor 36 serves to pull the plus base of op-amp 30 to the full plus regulated DC bus voltage at initial turn-on. As capacitor 36 charges to the voltage differential between the voltages on the wiper arm of potentiometer 21 and of the plus d.c. bus, the plus base signal input of op-amp 30 will drop to the level set by the wiper arm of potentiometer 22. This operation, wherein the positive input of op-amp 30 goes first to full power and then drops back to the referenced control point, is useful where the starting characteristics of a particular electrical load, such as a fluorescent lamp, are well served by providing full voltage for a finite time period or number of AC cycles so as to stabilize the lamp's arc prior to starting the control phase. Other loads, such as an incandescent lamp, are the opposite in operation and would be better served by controlling "upward" from zero power so as to slowly heat the tungsten filament and thus avoid thermal shock.

In the case of a lighting system, potentiometer 22 could be replaced with a photoresistive cell or like photodetector so that, as the photocell receives more incident light, the resistance thereof will decrease and thereby change the output voltage of the voltage divider going to the plus input 30*a* of op-amp 30. This would result in a decrease in the time duration of the positive output of op-amp 30, meaning that the light output would be controlled "downward" as the ambient light increased. Replacing potentiometer 21 with such a photocell and disconnecting the wiper arm of potentiometer 27 from a signal common bus 23, and re-connecting the wiper arm to the plus base 30*a* of op-amp 30, would cause an increase in the output of op-amp 30 with an increase in light to the photocell. This operation could be useful, for example, where a light source is to follow the intensity of another light source. It will, of course, be understood that positive or negative temperature coefficient thermistors as well as other sensors, including infrared, ultrasonic, and humidity sensors could be easily adapted so as to control the output of op-amp 30 as a function of the sensed variable. In this way, the system can be adapted to control current handling device which, in turn, control the output of electrical load devices whose outputs depend on either a proportional or step change in the current flowing through the load device.

Figure 6:
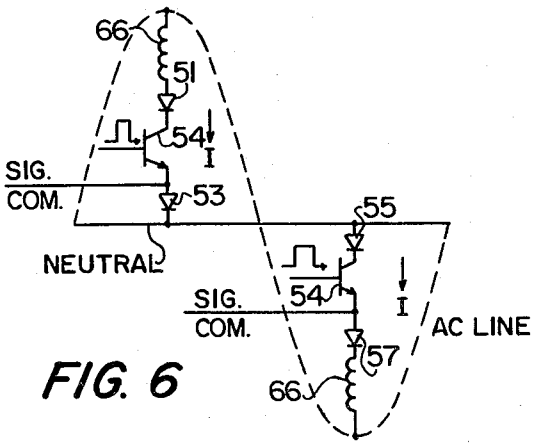
FIG. 6 is a circuit diagram of a portion of the circuit of FIG. 4, with the AC line waveform superimposed thereon illustrating the operation of that portion of the circuit.

Turning again to FIG. 4 and the description of the circuit illustrated therein, the third functional section of this circuit is, as stated above, what has been termed as a full-on current, time controlled transistor circuit 50. Circuit 50 consists of a full wave bridge 59 (formed by diodes 51, 53, 55 and 57) and transistors 52 and 54 and an optional "pull down" resistor 56. Transistor 52 derives its collector current from the DC supply but could be connected to the collector of transistor 54, providing that transistor 52 had a suitable voltage withstand characteristic. Transistor 54 is connected across the DC terminals of full wave bridge 50. The AC terminals of bridge 50 are respectively connected to one side 62 of the AC line and to the other side 64 of the AC line through an electrical load device 66. The square wave time related output of op-amp 30 provides transistors 52 and thus transistor 54 with a saturation level full-on signal at the zero crossover point of the AC cycle. When transistors 52 and 54 are turned on, a compliance load current develops and is conducted first through one of the bridge diodes 51 or 55, then through the saturated-on transistor 54, and then through another one of the bridge diodes 53 or 57. The specific conducting diodes depend on the half wave polarity as shown by the current paths illustrated in FIG. 6, which superposes the conducting circuit components on the corresponding A.C. half waves. If the control circuit is operating at anything less than full on, transistor 54 is turned off at some point within the time period of a voltage half wave. This load current interruption during the AC voltage cycle could create EMI problems and present transistor 54 with a severe DVDT problem. In fact, the effect could be destructive if the load device has any inductance associated therewith because the stored energy developed by current flowing in an inductor must be dissipated. Therefore, an alternate current path must be provided so that ballast or load current can continue to flow when the transistor is turned off.

Figure 8:
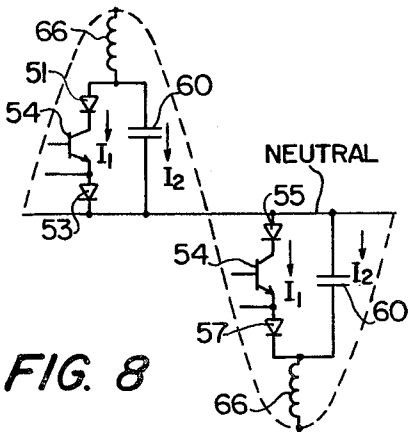
FIG. 8 is a circuit diagram similar to that shown in FIG. 6.
Figure 7A:
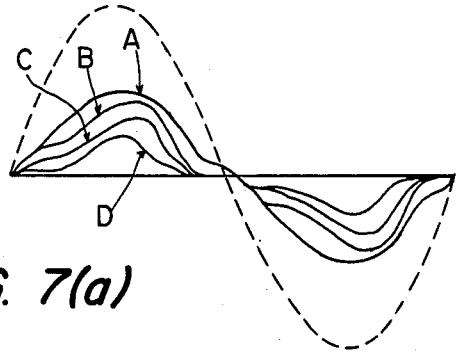
FIGS. 7(*a*) to 7(*c*) are current waveforms illustrating the operation of FIG. 4.
Figure 7B:
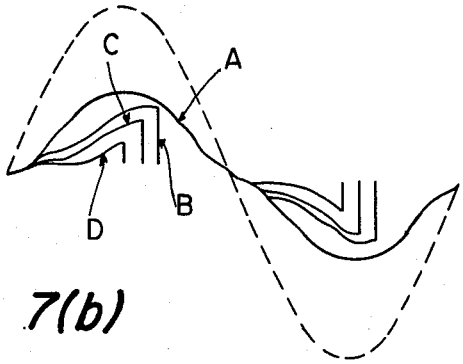
Figure 7C:
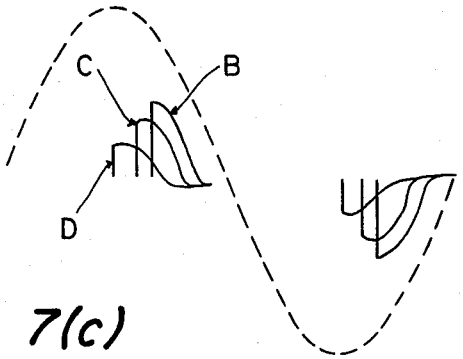

As stated above, the fourth functional "section" of the circuit is capacitor 60, which provides an alternate current path and thus insures that the load current is not abruptly interrupted despite transistor 54 being turned off. Referring to FIGS. 7(*a*) to 7(*c*), these figures illustrate the current wave forms of the load (FIG. 7(*a*) and the nominal division over time of the load current between the transistor current path (FIG. 7(*b*) and the capacitor current path (FIG. 7(*c*). The waveforms A, B, C and D in FIG. 7(*a*) correspond to the ballast currents at 90, 70, 50 and 30 watts of power, respectively, while curves A, B, C, D in FIG. 7(*b*) correspondingly show the waveforms for the portion of the ballast current flowing through the transistor current path. Curves B, C and D in FIG. 7(*c*) show the corresponding waveforms for the portion of the ballast current which flows through the capacitor current path, it being noted that there is substantially no current flow for 90 watts of power (almost all of the current flows through the transistor path). FIG. 8 is a diagram similar to that of FIG. 6 which shows both the transistor and capacitor current paths relative to the half wave polarity.

It will be appreciated that the transistor control system, operating either full-on or full-off with an alternate current path to ensure a continuously flowing load current, is by nature non-dissipative. Because the control transistor 54 is turned full-on during the rising voltage portion of the AC voltage half wave, the load current complies to whatever level permitted by the voltage source and load combination. This operation permits loads to be connected in parallel so long as the components used are properly chosen. Thus, the transistor 52 must have adequate base drive (and beta), transistor 54 and diodes 51, 53, 55 and 57 must have adequate current and voltage ratings, and capacitor 60 must be of a value adequate to provide a current path with a suitable energy storage value to accept the load current when the transistor current path is removed. It will be understood that the capacitance in the passive alternate current path also provides the system with some correction of the leading power factor inherent in such systems by virtue of the capacitance becoming "circuit active" during the latter portion of of the A.C. halfwave as shown in FIG. 3(*c*).

Although the invention has been described in relation to exemplary embodiments thereof, it will be understood by those skilled in the art that variations and modifications can be effected in these exemplary embodiments without departing from the scope and spirit of the invention.

I claim:

1. An electrical control system for controlling the current flow from an A.C. voltage supply to an electrical load device, said control system comprising:

electronic switching means, connected to said load so as to provide a controlled current path to the load, for providing for the application of substantially the entire available A.C. input voltage to the load during the initial portion of the A.C. supply voltage half wave and for switching off this input voltage at a variable point in time during said A.C. supply voltage half wave; and capacitor means, comprising a capacitor connected so as to provide an alternate current path to the load when said input voltage is switched off by said electronic switching means, for sustaining the current flow to the load when said input voltage is switched off by said electronic switching means.

2. An electrical control system as claimed in claim 1 wherein said electronic switching means comprises a transistor, and control means for turning said transistor full-on during said initial portion of the A.C. supply voltage half wave and for turning said transistor off at a said variable point in time.

3. An electrical control system as claimed in claim 2 wherein said control means includes an operational amplifier including first and second inputs and means applying a ramp function to one of said inputs for controlling switching of the output signal of said operational amplifier from a first level to a second level at a variable point in time in said A.C. voltage half wave, corresponding to the said point in time that turning off of said transistor takes place.

4. An electrical control system as claimed in claim 3 wherein said control means further comprises means for controlling the slope of said ramp function and thereby controlling the point in time at which said transistor is turned off.

5. An electrical control system as claimed in claim 4 wherein said means for controlling the slope of said ramp function comprises a variable resistance device.

6. An electrical control system as claimed in claim 5 wherein said variable resistance device comprises a potentiometer.

7. An electrical control system as claimed in claim 5 wherein said variable resistance device comprises a photodetector means whose resistance varies in relationship to ambient light.

8. An electrical control system as claimed in claim 7 wherein said load is an inductive ballast for a fluorescent lamp and said photodetector means senses the ambient light in the area in which said lamp is disposed.

9. An electrical control system as claimed in claim 8 further comprising capacitor charging circuit means, connected to one of the inputs of said operational amplifier, for providing that the positive output of the operational amplifier begins initially at full power and thereafter drops back to a reference level after a preselected time period determined by a capacitor charging circuit means.

10. An electrical control system as claimed in claim 2 wherein said control means includes an operational amplifier having negative and positive base inputs, said system further comprising a ramp voltage generating circuit for applying a ramp voltage input to the negative base input of said operational amplifier.

11. An electrical control system as claimed in claim 10 further comprising a pair of potentiometers for applying an input signal to the positive base input of said operational amplifier, one of said potentiometers being connected to provide a minimum level reference setting for the other, and said operational amplifier producing a positive output during the time period which the positive base signal exceeds the ramp voltage.

12. An electrical control system as claimed in claim 11 further comprising a further capacitor connected between a voltage supply bus and the wiper arm of one of said potentiometers.

13. An electrical control system as claimed in claim 12 wherein said ramp generating circuit comprises a diode and a transistor pair, the further capacitor being connected across emitter-collector circuit of one of said transistors of said transistor pair.

14. An electrical control system as claimed in claim 13 wherein said transistor is connected in between two opposed terminals of diode bridge and said capacitor is connected across the other two opposed terminals of said bridge, in series with the load.

15. An electrical control system for controlling the current flow from an AC voltage supply to a AC electrical load device, said control system comprising:

electronic switching means, connected to the said load so as to provide a controlled current path to the load, for providing for substantially the entire available AC input voltage to be applied to the load at least during the beginning portion of each alternating AC voltage half wave and for selectively switching off the input voltage at a variable point in time in a latter portion of said AC supply voltage half wave; and capacitor means, comprising a bi-polar AC capacitor connected in series with the load, for providing a sustaining path for the AC load current so that the AC load current will continue to flow to the extent permitted by the circuit impedances of the load, capacitor and AC supply voltage when said electronic switching means switches off and for providing compensating power factor correction only during said latter portion of said AC supply voltage half wave when said electronic switching means switches off.

16. An electrical control system as claimed in claim 15 wherein said electronic switching means comprises a transistor and control means for turning said transistor full-on during said beginning portion of the AC supply voltage half wave and for selectively turning said transistor off at a said variable point in time.

17. A electrical control system as claimed in claim 16 wherein said control means comprises ramp function generator and an operational amplifier having one input connected to the output of said ramp function generator.

18. In combination, at least one gas discharge lamp, an AC operated ballast transformer, for said at least one lamp, and an electrical control system for controlling the current flow from an AC voltage supply to the primary winding of said ballast transformer, said control system comprising:

electronic switching means, connected to said ballast transformer primary so as to provide a controlled current path to the ballast transformer primary, for providing for substantially the entire available AC input voltage to be applied to the ballast transformer primary at least during the beginning portion of each alternating AC supply voltage half wave and for selectively switching off the input voltage at a variable point in time in a latter portion of said AC supply voltage half wave; and capacitor means, comprising a bi-polar AC capacitor connected in series with the ballast transformer primary and in parallel with said electronic switching means, for providing a sustaining path for the AC load current so that the AC load current will continue to flow to the extent permitted by the circuit impedances of the ballast, capacitor and AC supply voltage when said electronic switching means is switched off and for providing power factor correction during said latter portion of said AC supply voltage half wave.

19. A combination as claimed in claim 18 wherein said electronic switching means comprises a transistor and control means for turning said transistor full-on during said beginning portion of the AC supply voltage half wave and for selectively turning said transistor off at a said variable point in time.

20. A combination as claimed in claim 19 wherein said control means comprises ramp function generator and an operational amplifier having one input connected to the output of said ramp function generator.

* * * * *

US004352045B1

REEXAMINATION CERTIFICATE (2306th)

United States Patent [19]

Widmayer

[11] B1 4,352,045

[45] Certificate Issued May 31, 1994

[54] ENERGY CONSERVATION SYSTEM USING CURRENT CONTROL

[75] Inventor: Don F. Widmayer, Bethesda, Md.

[73] Assignee: Flexiwatt Corporation, Rockville, Md.

Reexamination Request:
No. 90/000,523, Mar. 8, 1984

Reexamination Certificate for:

| | |
|---|---|
| Patent No.: | **4,352,045** |
| Issued: | **Sep. 28, 1982** |
| Appl. No.: | **284,590** |
| Filed: | **Jul. 17, 1981** |

[51] Int. Cl.[5] ..... H05B 37/02; H05B 41/392

[52] U.S. Cl. ..... 315/291; 315/208; 315/240; 315/247; 315/287; 315/DIG. 4; 323/351

[56] References Cited

U.S. PATENT DOCUMENTS

| | | | |
|---|---|---|---|
| 3,422,309 | 1/1969 | Spira et al. | 315/194 |
| 4,099,099 | 7/1978 | Grudelbach | 315/194 |
| 4,350,935 | 9/1982 | Spira et al. | 315/291 |

*Primary Examiner*—David K. Moore
*Assistant Examiner*—Michael Cammarata

[57] ABSTRACT

An electrical energy conservation control method and apparatus are provided which produce efficient control of the light output of either incandescent or fluorescent lamps or the outputs of other electrical load devices under circumstances where the rated output is not required. The control method and apparatus combines electronic (transistor) switching techniques with the use of reactive circuit components to provide control of the magnitude of current flowing through the load device during the AC input voltage sine wave and to permit some current flow at all times during each voltage half wave. The control technique is non-dissipative in the sense that losses are virtually limited to switching transitions and passive circuit element losses. The control is accomplished by controlling the time period that a transistor is saturated full-on. The transistor is saturated on at the beginning of each voltage half wave and continues to be saturated on until the point is time within each half wave when the transistor is turned off. At that point in time, a non-dissipative current-limiting capacitor provides an alternate current path for the load current. This operation combats the intrinsic non-linear characteristics of inductive loads and causes less power factor change.

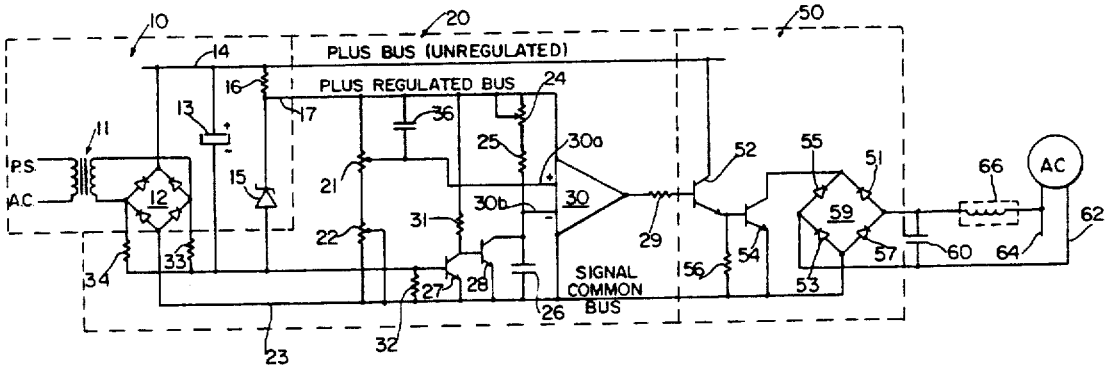

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1–4, 10, 11, 15–20 are cancelled.

Claims 5, 12 are determined to be patentable as amended.

Claims 6–9, 13, 14, dependent on an amended claim, are determined to be patentable.

5. [An electrical control system as claimed in claim 4] *An electrical control system for controlling the current flow from the A.C. supply terminals of an A.C. voltage supply to an electrical load device comprising an inductive ballast and at least one fluorescent lamp having heated cathodes so as to provide dimming control for said at least one lamp, said control system comprising:*

*a full wave A.C. bridge rectifier circuit having A.C. terminals and D.C. terminals, one of said A.C. terminals of said rectifier circuit being connected to one of said A.C. supply terminals;*

*a control transistor connected to said load through said A.C. bridge rectifier circuit so as to provide a controlled current path to the load;*

*electronic switching means for switching on said transistor at a point in time at least close to the zero crossover point of the A.C. supply voltage and maintaining said transistor on during an initial portion of the A.C. supply voltage halfwave to provide for the application of substantially the entire available A.C. supply voltage to the load during the initial portion of the A.C. supply voltage half wave and for switching off said transistor at a variable point in time after said initial portion during said A.C. supply voltage half wave and for maintaining said transistor switched off during the remainder of the half wave so as to control current flow through the at least one lamp and thereby control the amount of dimming provided by said at least one lamp;*

*a substantially non-resistive means, comprising at least one capacitor, connected across the A.C. terminals of said A.C. bridge rectifier circuit and being of a capacitance value sufficient to provide an alternative current path for substantial current flow to the load when said transistor is switched off by said electronic switching means and thereby provide continuous current flow from the A.C. supply terminals of said A.C. source to the load when said transistor is switched off by said electronic switching means during the remainder of the A.C. supply voltage halfwave so as to maintain current flow through said at least one lamp, over the entire dimming range of the system;*

*wherein said electronic switching means comprises a transistor, and control means for turning said transistor full-on during said initial portion of the A.C. supply voltage half wave and for turning said transistor off at a said variable point in time;*

*wherein said control means includes an operational amplifier including first and second inputs and means applying a ramp function to one of said inputs for controlling switching of the output signal of said operational amplifier from a first level to a second level at a variable point in time in said A.C. voltage half wave, corresponding to the said point in time that turning off of said transistor takes place;*

*wherein said control means further comprises means for controlling the slope of said ramp function and thereby controlling the point in time at which said transistor is turned off; and* wherein said means for controlling the slope of said ramp function comprises a variable resistance device.

12. [An electrical control system as claimed in claim 11] *An electrical control system for controlling the current flow from the A.C. supply terminals of an A.C. voltage supply to an electrical load device comprising an inductive ballast and at least one fluorescent lamp having heated cathodes so as to provide dimming control for said at least one lamp, said control system comprising;*

*a full wave A.C. bridge rectifier circuit having A.C. terminals and D.C. terminals, one of said A.C. terminals of said rectifier circuit being connected to one of said A.C. supply terminals;*

*a control transistor connected to said load through said A.C. bridge rectifier circuit so as to provide a controlled current path to the load;*

*electronic switching means for switching on said transistor at a point in time at least close to the zero crossover point of the A.C. supply voltage and maintaining said transistor on during an initial portion of the A.C. supply voltage halfwave to provide for the application of substantially the entire available A.C. supply voltage to the load during the initial portion of the A.C. supply voltages half wave and for switching off said transistor at a variable point in time after said initial portion during said A.C. supply voltage half wave and for maintaining said transistor switched off during the remainder of the half wave so as to control current flow through the at least one lamp and thereby control the amount of dimming provided by said at least one lamp;*

*a substantially non-resistive means, comprising at least one capacitor, connected across the A.C. terminals of said A.C. bridge rectifier circuit and being of a capacitance value sufficient to provide an alternative current path for substantial current flow to the load when said transistor is switched off by said electronic switching means and thereby provide continuous current flow from the A.C. supply terminals of said A.C. source to the load when said transistor is switched off by said electronic switching means during the remainder of the A.C. supply voltage halfwave so as to maintain current flow through said at least one lamp, over the entire dimming range of the system;*

*wherein said electronic switching means comprises a transistor, and control means for turning said transistor full-on during said initial portion of the A.C. supply voltage half wave and for turning said transistor off at a said variable point in time;*

*wherein said control means includes an operational amplifier having negative and positive base inputs, said system further comprising a ramp voltage gener-*

*ating circuit for applying a ramp voltage input to the negative base input of said operational amplifier;*

*further comprising a pair of potentiometers for applying an input signal to the positive base input of said operational amplifier, one of said potentiometers being connected to provide a minimum level reference setting for the other, and said operational amplifier producing a positive output during the time period which the positive base signal exceeds the ramp voltage; and* further comprising a further capacitor connected between a voltage supply bus and the wiper arm of one of said potentiometers.

* * * * *